US006988680B1

(12) United States Patent
Boecking

(10) Patent No.: US 6,988,680 B1
(45) Date of Patent: Jan. 24, 2006

(54) INJECTOR OF COMPACT DESIGN FOR A COMMON RAIL INJECTION SYSTEM FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 467 days.

(21) Appl. No.: 09/807,922

(22) PCT Filed: Aug. 18, 2000

(86) PCT No.: PCT/DE00/02825

§ 371 (c)(1),
(2), (4) Date: Aug. 20, 2001

(87) PCT Pub. No.: WO01/14722

PCT Pub. Date: Mar. 1, 2001

(30) Foreign Application Priority Data

Aug. 23, 1999 (DE) ..... 199 39 939

(51) Int. Cl.
*F02M 61/20* (2006.01)

(52) U.S. Cl. ..... 239/533.9; 239/96; 239/533.3

(58) Field of Classification Search ..... 239/88, 239/96, 533.3, 533.9, 533.8, 585.1
See application file for complete search history.

(56) References Cited

U.S. PATENT DOCUMENTS

| | | | | |
|---|---|---|---|---|
| 4,798,186 A | * | 1/1989 | Ganser | 239/585.1 |
| 5,487,508 A | * | 1/1996 | Zuo | 239/533.9 |
| 6,260,768 B1 | * | 7/2001 | Timms | 239/88 |
| 6,412,706 B1 | * | 7/2002 | Guerrassi et al. | 239/96 |

FOREIGN PATENT DOCUMENTS

| | | | |
|---|---|---|---|
| DE | 196 34 105 A | | 1/1998 |
| EP | 0 393 590 A | | 10/1990 |
| EP | 0 426 205 A | | 5/1991 |
| EP | 0 529 630 A | | 3/1993 |
| EP | 0 582 993 A | | 2/1994 |
| GB | 2316447 | * | 2/1998 |
| GB | 2 319 302 A | | 5/1998 |
| JP | 5-118260 A | | 5/1993 |

OTHER PUBLICATIONS

Patent Abstracts of Japan vol. 017, No. 486 (M–1473). Sep. 3, 1993.

* cited by examiner

*Primary Examiner*—Steven J. Ganey
(74) *Attorney, Agent, or Firm*—Ronald E. Greigg

(57) ABSTRACT

A common rail injector is proposed which is very compact in structure and nevertheless brings high closing forces to bear at the end of the injection. This is attained, among other provisions, in that the closing piston has a larger diameter than the nozzle needle.

18 Claims, 2 Drawing Sheets

INJECTOR OF COMPACT DESIGN FOR A COMMON RAIL INJECTION SYSTEM FOR INTERNAL COMBUSTION ENGINES

CROSS-REFERENCE TO RELATED APPLICATIONS

This application is a 35 USC 371 application of PCT/DE00/02825 filed on Aug. 18, 2000.

BACKGROUND OF THE INVENTION

1. Field of the Invention

The invention relates to an injector for a common rail injection system for internal combustion engines, having a valve control chamber, defined by the end face of a nozzle needle, in which the fuel inlet takes place via an inlet throttle and the fuel outlet takes place via an outflow C throttle, and there is a closing piston in the valve control chamber.

2. Description of the Prior Art

To reduce the structural length of conventional injectors, various efforts have been made, with the goal of X constructing injectors in which the nozzle needle discharges N directly into the valve control chamber, and no valve piston is necessary. From European Patent 0 426 205, an injector is known in which the nozzle needle discharges directly into the valve control chamber. Located in the valve control chamber are a control element and a closing piston. A disadvantage of this design is that the closing piston and the control element with an inlet throttle and outflow throttle are disposed in line with one another, so that despite the omission of the valve piston, the structural length of the injector is still comparatively great. Furthermore, the closing forces at the end of injection are relatively slight.

SUMMARY OF THE INVENTION

The object of the invention is to furnish an injector that is especially compact in structure and simple in design, and in which the closing forces at the end of injection are high.

According to the invention, this object is attained by an injector for a common rail injection system for internal combustion engines, having a valve control chamber, defined by the end face of a nozzle needle, in which the fuel inlet takes place via an inlet throttle and the fuel outlet takes place via an outflow throttle, and there is a closing piston, which has a greater diameter than the nozzle needle, in the valve control chamber.

This injector has the advantage that its structural length is especially short, since there is only one closing piston in the valve control chamber. Furthermore, in the injector of the invention the closing force at the end of injection is especially high, because the diameter of the closing piston is greater than the diameter of the nozzle needle. Finally, by reducing the number of components of the injector, a simple design of the injector has been achieved.

A variant of the injector of the invention provides that the closing piston is disposed between the inlet throttle and outflow throttle on one side and the nozzle needle on the other, so that the closing piston also takes on control tasks.

In another embodiment, it is provided that the closing piston has a first bore, extending between its end faces, so that the positive displacement work which the nozzle needle must perform upon opening of the injection nozzle counter to the pressure in the valve control chamber is slight.

In an advantageous feature of the invention, the closing piston has a throttle bore extending between its end faces, so that after the end of injection, the closing piston can be returned to its outset position at a defined speed.

In a supplement to the invention, a stroke stop is provided in the valve control chamber and limits the displaceability of the closing piston in the direction of the inlet throttle and the outflow throttle, so that the fuel can flow unhindered into and out of this portion of the valve control chamber.

In a further version, a closing spring is present, which is braced against the closing piston and the nozzle needle, so that after the end of injection the closing piston is moved into its outset position by the spring force.

In an advantageous feature, it is provided that the closing spring is disposed in the valve control chamber, so that a simple design is assured, and the spring force acts directly on the closing piston.

In a supplement to the invention, it is provided that the closing spring is braced against the end face of the nozzle needle, so that the nozzle needle is simple in design.

Another variant provides that the nozzle needle has a pin protruding in the direction of its longitudinal axis and past its end face, so that the portion of the valve control chamber defined by the closing piston and the end face of the nozzle needle does not fail to attain a minimum volume predetermined by the length of the pin. Because of the elasticity of the fuel, this minimum volume brings about a certain elasticity or "softness" of the injector in the valve control chamber and the walls of the valve control chamber.

In another variant of the invention, the first bore of the closing piston is closable by the pin, so that with the the injection nozzle open, the pressure in the valve control chamber between the closing piston and the nozzle needle drops no more than necessary, and the leakage losses between the nozzle needle and the valve control chamber are reduced.

In a supplement to the invention, it is provided that the first bore of the closing piston has a sealing seat on the face end toward the nozzle needle, and the pin has a corresponding sealing cone, so that especially good sealing between the pin and the closing piston is achieved.

A variant provides that the inlet throttle and/or the outflow throttle is disposed in a housing of the injector, so that the dimensions of the injector are reduced still further.

BRIEF DESCRIPTION OF THE DRAWINGS

Further advantages and advantageous features of the invention can be learned from the ensuing description, taken with the drawings, in which.

DESCRIPTION OF THE PREFERRED EMBODIMENTS

Figure 1:
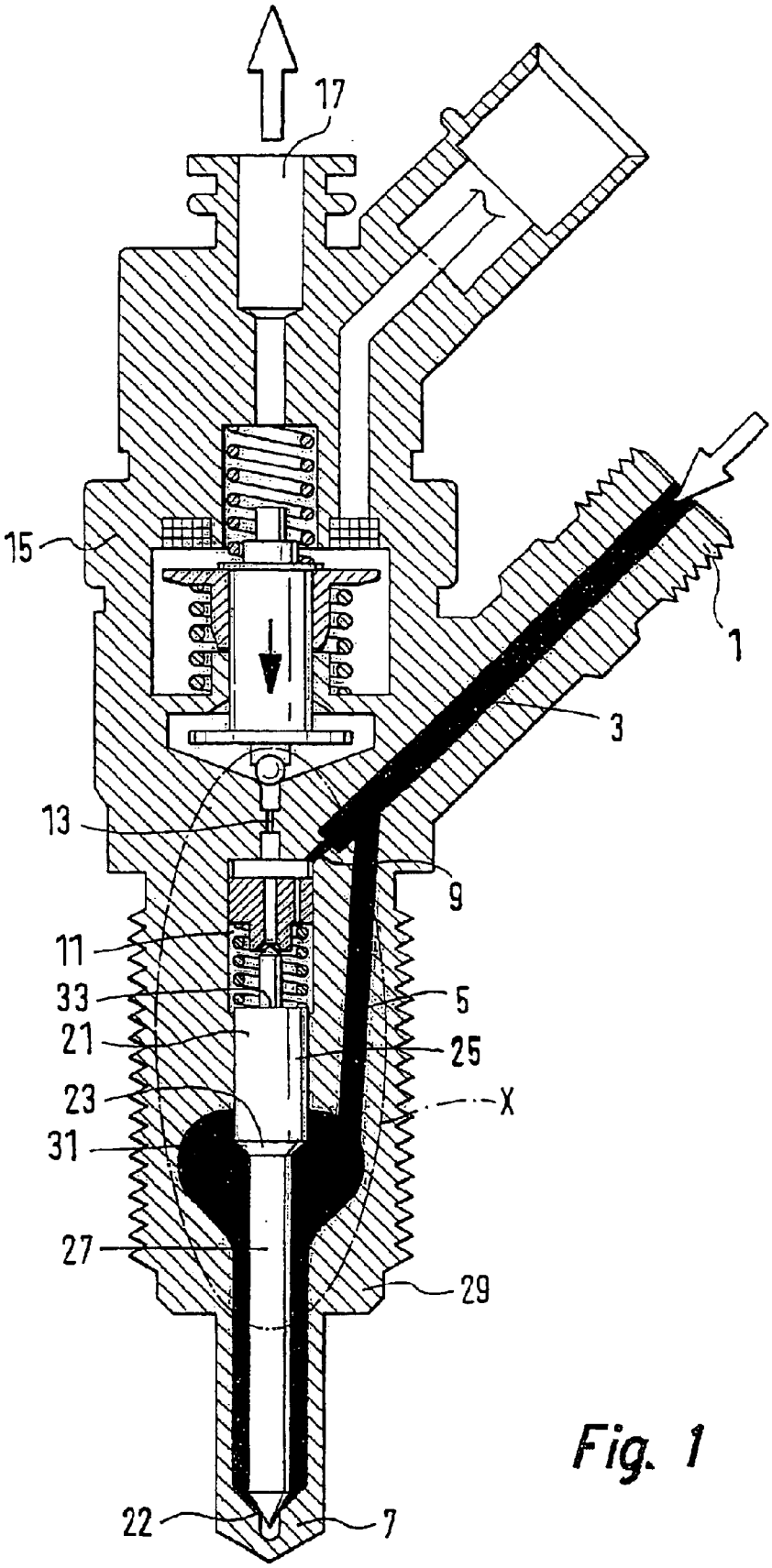
FIG. 1 is a cross section through an injector according to the invention.

In FIG. 1, an injector according to the invention is shown. Via a high-pressure connection stub 1, fuel 3 is carried via an inlet conduit 5 to an injection nozzle 7 and via an inlet throttle 9 into a valve control chamber 11. The valve control chamber 11 communicates with a fuel return 17 via an outflow throttle 13, which can be opened by a magnet valve 15. The fuel 3 is shown in FIG. 1 as a black area.

The valve control chamber 11 is defined by a nozzle needle 21. The nozzle needle 21 prevents the fuel 3, which is under pressure, from flowing into the combustion chamber, not shown, between injections. This is achieved by the provision that the nozzle needle 21 is pressed into a nozzle needle seat 22 and seals off the inlet conduit 5 from the combustion chamber, not shown.

The nozzle needle 21 has a cross-sectional change 23 from a larger diameter 25 to a smaller diameter 27. The nozzle needle 21 is guided with its larger diameter 25 in a housing 29. The cross-sectional change 23 defines a pressure chamber 31 of the injection nozzle 7.

Figure 2:
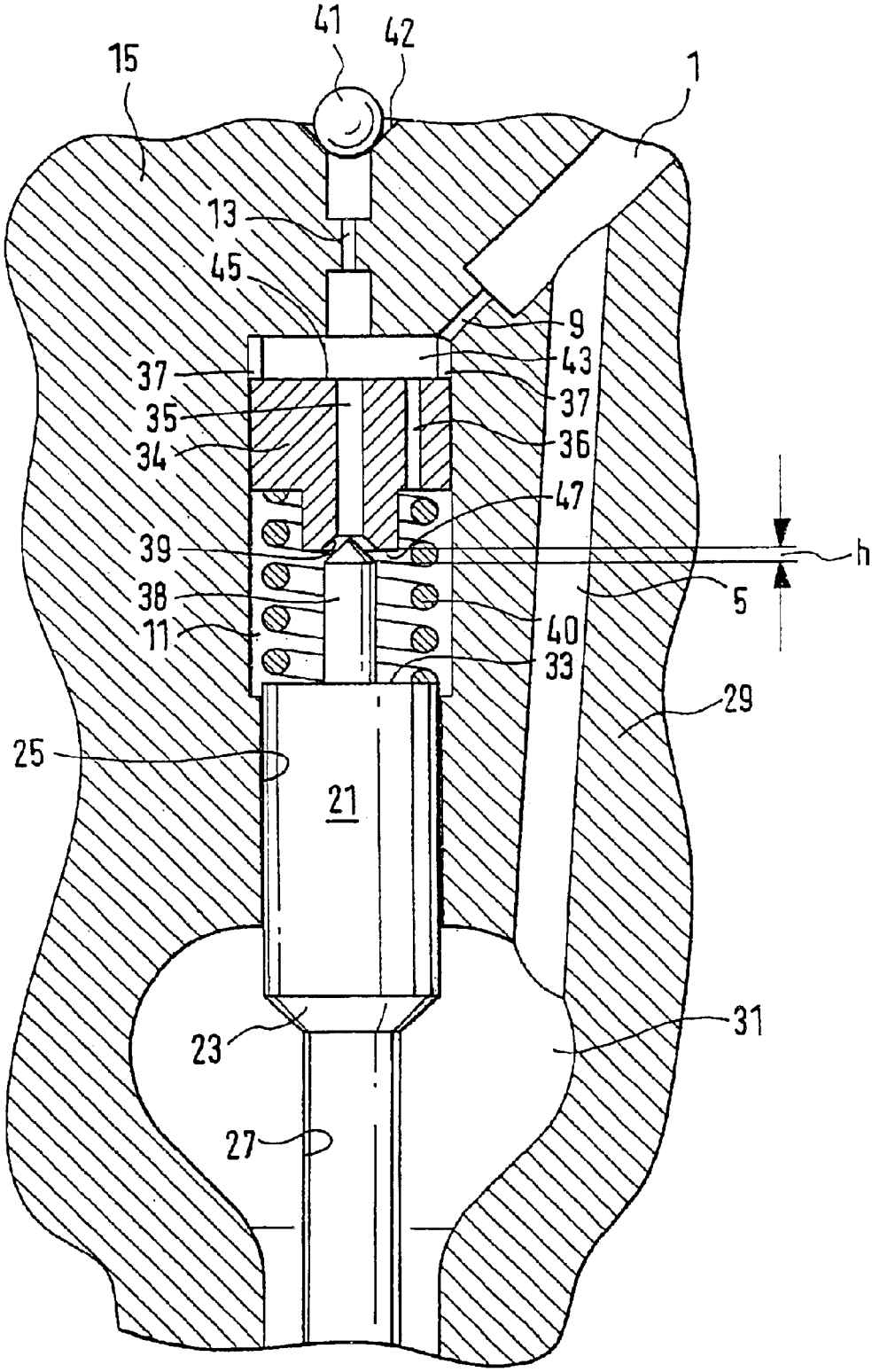
FIG. 2 is an enlarged detail X of FIG. 1.

In FIG. 2, an enlarged detail X of FIG. 1 of the injector of the invention is shown. In this view it can be seen that the valve control chamber 11 is defined by an end face 33 of the nozzle needle 21. A closing piston 34 is located in the valve control chamber 11 and has a first, larger bore 35 and a second, smaller throttle bore 36. The stroke of the closing piston 34 in the direction of the magnet valve 15 is limited by a stroke stop 37. A pin 38 with a conical tip that fits into a complimentary sealing seat 39 of the closing piston 34 protrudes from the end face 33 of the nozzle needle 21. FIG. 2 shows a state of the injector in which the closing piston 34 rests on the stroke stop 37, and the nozzle needle is seated on its nozzle needle seat 22, not shown in FIG. 2. In this position, there is a gap between the pin 38 and the sealing seat 39 of the closing piston 34, so the fuel 3, not shown in FIG. 2, can flow through the first bore 35 of the closing piston 34 into the part of the valve control chamber 11 located between the closing piston 34 and the nozzle needle 21.

When the outflow throttle 13 is closed, the hydraulic force acting on the end face 33 of the nozzle needle 21 is greater than the hydraulic force acting the cross-sectional change 23, because the end face 33 of the nozzle needle 21 is larger than the annular face of the area of the cross-sectional change 23. If the high-pressure pump, not shown, of the fuel injection system is not driven because the engine is at a stop, then a closing spring 40, acting on the end face 33 of the nozzle needle 21, presses the nozzle needle 21 against the nozzle needle seat 22 shown in FIG. 1 and thus closes the injection nozzle 7 or injector.

When the outflow throttle 13 is opened, which happens when a ball 41 of the magnet valve 15, not described in detail, is lifted from a ball seat 42, the pressure in the valve control chamber 11 drops. As a consequence, the hydraulic force acting on the end face 33 drops as well. As soon as this hydraulic force is less than the hydraulic force acting on the cross-sectional change area 23, the nozzle needle 21 moves in the direction of the closing piston 34, until the pin 38 rests on the sealing seat 39. As a result, the injection nozzle 7 shown in FIG. 1 is opened, and the fuel 3 is injected into the combustion chamber. The opening travel of the nozzle needle 21 is represented in FIG. 2 by the nozzle needle stroke "h".

The inlet throttle 9 prevents a complete pressure equalization between the inlet conduit 5 and the valve control chamber 11. The opening speed of the nozzle needle 21 is determined by the difference in flow between the inlet throttle 9 and the outflow throttle 13.

This indirect triggering of the nozzle needle 21 via a hydraulic force booster system is necessary, because the forces required for rapid opening of the nozzle needle 21 cannot be generated directly with the magnet valve 15. The so-called "control quantity" required in addition to the fuel quantity injected into the combustion chamber reaches the fuel return 17 via the inlet throttle 9, the valve control chamber 11, and the outflow throttle 13. In addition to the control quantity, leakage also occurs at the nozzle needle guide. The control and leakage quantities can amount to up to 50 $mm^3$ per stroke. They are returned to the fuel tank, not shown, via the magnet valve 15.

To terminate the injection, the outflow throttle 13 is closed by the ball 41 of the magnet valve 15, in a known manner not explained in further detail. As a result of the closure of the outflow throttle 13, virtually the same rail pressure builds up again via the inlet throttle 9 in a portion 43 of the valve control chamber 11 that is defined by the closing piston 34 and the outflow throttle 13. This pressure exerts a hydraulic force on the nozzle needle 21 via the end face 45 of the closing piston 34 and via the pin 38 resting on the sealing seat 39. As soon as this hydraulic force exceeds the hydraulic force acting on the cross-sectional change area 23, the nozzle needle 21 closes. Because the end face 45 of the closing piston is markedly larger in comparison to the annular face area of the cross-sectional change 23, the closing motion takes place very fast and with great force. Simultaneously with the closing motion, a small portion of the fuel, flowing into the portion 43 of the valve control chamber 11, flows through the throttle bore 36 into the valve control chamber 11 defined by the closing piston 34 and by the end face 33 of the nozzle needle 21. The closing motion takes place so fast that before a pressure equalization is reached, the nozzle needle 21 rests on the nozzle needle seat 22 again, and the injection is terminated. The closing speed of the nozzle needle 21 is determined essentially by the flow through the inlet throttle 9.

In order for the closing piston 34 to move to the outset position against the stroke stop 37 after the end of injection, the portion of the valve control chamber 11 defined by the closing piston 34 and the end face 33 of the nozzle needle 21 is filled with fuel through the throttle bore 36, while the closing spring 40 presses the closing piston 34 upward. It is also conceivable to omit the throttle bore 36 and to dimension the play of the closing piston 34 in the housing 29 in such a way that the fuel flows through the annular gap between the closing piston 34 and the housing 29. The second end face 47 of the closing piston 34 can also, as shown in FIG. 2, have a shoulder, which serves for instance to guide the closing spring 40.

The foregoing relates to a preferred exemplary embodiment of the invention, it being understood that other variants and embodiments thereof are possible within the spirit and scope of the invention, the latter being defined by the appended claims.

I claim:

1. In an injector for a common rail injection system for internal combustion engines, having a valve control chamber (11) defined at one end by the end face (33) of a nozzle needle (21), in which the fuel inlet to the control chamber takes place via an inlet throttle (9) and the fuel outlet takes place via an outflow throttle (13), and there is a closing piston (34) in the valve control chamber (11), the improvement wherein the closing piston (34) has a larger diameter than the nozzle needle (21) and wherein the closing piston (34) has a first bore (35), extending between its end faces (45, 47).

2. The injector of claim 1, wherein the closing piston (34) is disposed between the inlet throttle (9) and outflow throttle (13) on one side and the nozzle needle (21) on the other.

3. The injector of claim 2, wherein the closing piston (34) has a throttle bore (36) extending between its end faces (45, 47).

4. The injector of claim 2, wherein that a stroke stop (37) is provided in the valve control chamber (11) and limits the displaceability of the closing piston (34) in the direction of the inlet throttle (9) and the outflow throttle (13).

5. The injector of claim 2, wherein a closing spring (40) is present, which is braced against the closing piston (34) and the nozzle needle (21).

6. The invention defined in claim 5, wherein said closing piston (34) has a first bore (35) and a throttle bore (36) extending between its end faces (45, 47).

7. The injector of claim 6, wherein that the closing spring (40) is disposed in the valve control chamber (11).

8. The injector of claim 2, wherein the nozzle needle (21) has a pin (38) protruding in the direction of its longitudinal axis and past its end face (33).

9. The injector of claim 1, wherein the closing piston (34) has a throttle bore (36) extending between its end faces (45, 47).

10. The injector of claim 1, wherein that a stroke stop (37) is provided in the valve control chamber (11) and limits the displaceability of the closing piston (34) in the direction of the inlet throttle (9) and the outflow throttle (13).

11. The injector of claim 1, wherein a closing spring (40) is present, which is braced against the closing piston (34) and the nozzle needle (21).

12. The injector of claim 1, wherein that the closing spring (40) is disposed in the valve control chamber (11).

13. The injector of claim 12, wherein the closing spring (40) is braced against the end face (33) of the nozzle needle (21).

14. The injector of claim 11, wherein the closing spring (40) is braced against the end face (33) of the nozzle needle (21).

15. The injector of claim 1, wherein the nozzle needle (21) has a pin (38) protruding in the direction of its longitudinal axis and past its end face (33).

16. The injector of claim 15, wherein the first bore (35) of the closing piston (34) is closable by the pin (38).

17. The injector of claim 16, wherein the first bore (35) of the closing piston (34) has a sealing seat (39) on the face end toward the nozzle needle (21), and the pin (38) has a corresponding sealing cone.

18. The injector of claim 1, wherein the inlet throttle (9) and/or the outflow throttle (13) is disposed in a housing (29) of the injector.

* * * * *